US006854547B2

(12) United States Patent
Moll et al.

(10) Patent No.: US 6,854,547 B2
(45) Date of Patent: Feb. 15, 2005

(54) REMOTE-CONTROL TOY VEHICLE WITH POWER TAKE-OFF MECHANISM

(75) Inventors: Joseph T. Moll, Prospect Park, PA (US); Aritty J. Newton, Moorestown, NJ (US); Michael B. DiBartolo, Collingswood, NJ (US)

(73) Assignee: Mattel, Inc., El Segundo, CA (US)

( * ) Notice: Subject to any disclaimer, the term of this patent is extended or adjusted under 35 U.S.C. 154(b) by 189 days.

(21) Appl. No.: 10/164,805

(22) Filed: Jun. 7, 2002

(65) Prior Publication Data

US 2003/0226701 A1 Dec. 11, 2003

(51) Int. Cl.[7] ..... B62H 1/00; A63H 17/00

(52) U.S. Cl. ..... 180/167; 180/65.1; 180/209; 180/211; 446/440; 446/456

(58) Field of Search ..... 180/167, 119, 180/199, 200, 6.2, 6.48, 15, 53.1, 53.5, 53.6, 65.1, 218, 219, 220, 223; 280/1.13, 1.16, 288.4; 446/437, 440, 441, 454, 456, 465

(56) References Cited

U.S. PATENT DOCUMENTS 6,149,179 A * 11/2000 Long ..... 280/293

* cited by examiner

*Primary Examiner*—Christopher P. Ellis
*Assistant Examiner*—Bridget Avery
(74) *Attorney, Agent, or Firm*—Akin Gump Strauss Hauer & Feld, LLP

(57) ABSTRACT

A toy vehicle comprising a frame, a first wheel, a second wheel, and a turning mechanism including a rotatable arm mounted to the frame and a rotatable third wheel mounted to the arm. The arm is rotatable between a retracted position and an extended position, wherein, in the extended position, the third wheel contacts the surface and lifts one of the first and second wheels off of the surface. The third wheel then rotates to rotate the vehicle about a remaining one of the first and second wheels in contact with the surface. The vehicle further comprises a motor mounted on the frame. The motor is operatively associated with one of wheels to propel the vehicle and with the turning mechanism to lift and turn the vehicle. The toy vehicle is controlled with a remote control unit which is shaped like a remote-vehicle-entry key chain.

15 Claims, 8 Drawing Sheets

REMOTE-CONTROL TOY VEHICLE WITH POWER TAKE-OFF MECHANISM

BACKGROUND OF THE INVENTION

This invention generally relates to remote-controlled toy vehicles, and more particularly to remote-controlled toy motorcycles.

Stability and control while turning have been difficult to achieve in toy motorcycles, and intricate systems have been developed in an attempt to do so. As the intricacies increase, so does the stability. Unfortunately, the price also tends to increase as the intricacies increase. The present invention seeks to remedy this problem by providing a new, inexpensive steering mechanism for toy motorcycles. Although intended to be used with toy motorcycles, the steering mechanism can also be used with other toy vehicles, such as toy cars and trucks. Additionally, another benefit of the steering mechanism is that it produces surprising movements of the vehicle, aiding in keeping the attention of the user.

BRIEF SUMMARY OF THE INVENTION

Briefly stated, in one aspect, the present invention is a toy vehicle configured to be maneuvered on a surface. The vehicle comprises a frame, a first wheel and a second wheel. Each wheel is rotatably mounted to the frame. The first wheel and the second wheel are generally in line along a center vertical plane of the frame and parallel to each other and to the center vertical plane. The vehicle further comprises a turning mechanism including a rotatable arm mounted to the frame and a third wheel mounted to the arm. The arm is rotatable in the center vertical plane between a retracted position and an extended position, wherein, in the extended position, the third wheel contacts the surface and lifts one of the first and second wheels off of the surface. The third wheel rotates to rotate the vehicle about a remaining one of the first and second wheels in contact with the surface.

In another aspect, the present invention is a toy vehicle for use on a surface. The vehicle comprises a frame having a first and a second end. At least a first propulsion wheel is rotatably mounted to the frame proximal one of the first and second ends. A turning mechanism includes a rotatable arm mounted to the frame and a steering wheel rotatably mounted to the arm. The arm is rotatable between a retracted position and an extended position, wherein, in the extended position, the steering wheel contacts the surface and lifts one of the first and second ends off of the surface and the steering wheel rotates to turn the vehicle about a remaining one of the first and second ends in contact with the surface. The toy vehicle further comprises a motor mounted on the frame. The motor is operably associated with at least the first wheel to propel the vehicle. The motor is further operably associated with the turning mechanism to lift and turn the vehicle.

In another aspect, the present invention is a toy vehicle for use on a surface. The vehicle comprises a frame, at least a first wheel and a second wheel each rotatably mounted to the frame, and a turning mechanism including a rotatable arm mounted to the frame and a third wheel rotatably mounted to the arm. The third wheel is rotatable in a direction transverse to the center vertical plane. The arm is rotatable between a retracted position and an extended position, wherein, in the extended position, the third wheel contacts the surface and lifts at least one of the first and second wheels off of the surface and the third wheel rotates to rotate the vehicle about a remaining at least one of the first and second wheels in contact with the surface.

In another aspect, the present invention is a power take-off mechanism for use in propelling and turning a toy vehicle having at least a first propulsion wheel. The power takeoff mechanism comprises a motor, a first clutch, and a second clutch. The first clutch is operably coupled with the motor so as to transfer rotation of the motor in only a first direction. The second clutch is operably coupled with the motor so as to transfer rotation of the motor in only a second direction opposite the first direction. The power take-off mechanism further comprises a first gear train and a second gear train. The first gear train is operatively coupled to at least the first propulsion wheel and the first clutch. The second gear train is operatively coupled to a turning mechanism and the second clutch. Upon the motor operating in a first direction, the first clutch causes engagement of the motor with the first gear train and the second clutch causes disengagement of the motor with the second gear train, causing the rotation of at least the first propulsion wheel, thereby propelling the vehicle. Upon the motor operating in a second direction, the second clutch causes engagement of the motor with the second gear train and the first clutch causes disengagement of the motor with the first gear train, causing rotation of the turning mechanism, thereby turning the vehicle.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
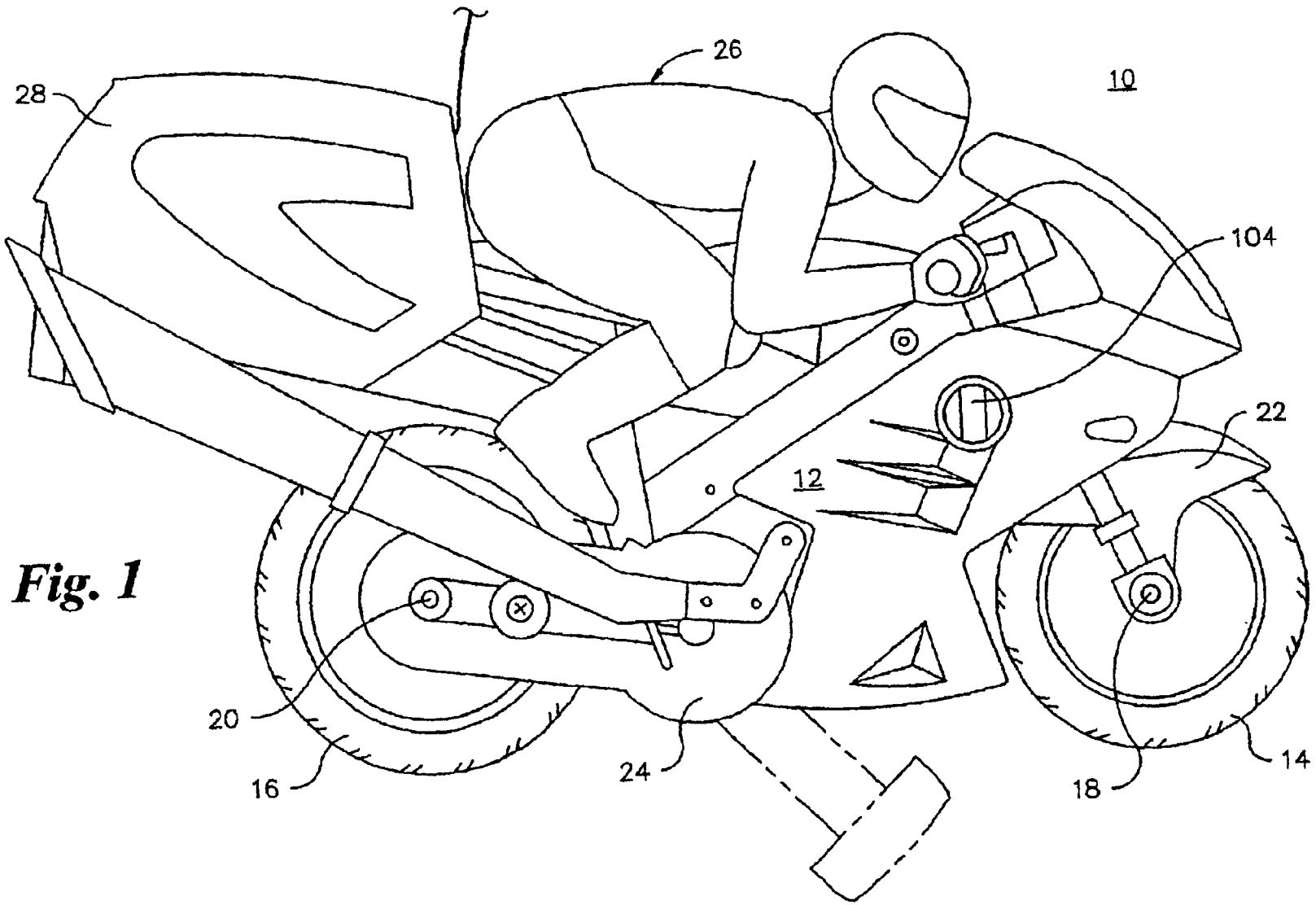
FIG. 1 is a side elevational view of the toy vehicle in accordance with a preferred embodiment of the present invention.

Certain terminology is used in the following description for convenience only and is not limiting. The words "right", "left", "upper" and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1 through 4 a first embodiment of a toy vehicle 10 in accordance with the present invention. Referring to FIG. 1 of the toy vehicle 10 comprises a frame indicated generally at 12 to which a first and second wheel 14, 16 are rotatably mounted. The first and second wheels 14, 16 are mounted proximal to the front and back ends, respectively, of the frame 12, generally in line with each other along a center vertical plane of the frame 12 which is parallel to the plane of FIG. 1. The first and second wheels 14, 16 are generally parallel to each other and the center vertical plane. To enhance stability, the first and second wheels 14, 16 are generally cylindrical, in that they are relatively wide and flat, such that the vehicle 10 is capable of standing upright on the first and second wheels 14, 16 while the vehicle 10 is stationary. To further enhance stability, it is preferred that the second, rear wheel 16 is wider than the first, front wheel 14. The first wheel 14 is rotatably maintained within a front wheel mount 22. The front wheel mount 22, the top of which is rigidly fixed to the frame 12, extends downwardly from the frame 12 in generally a yoke-like fashion, such that the first wheel 14 is maintained between the yoke arms of the front wheel mount 22, rotating about a first axle 18. A rear wheel mount 24 is rigidly fixed to the back of the frame 12, consisting of two arms extending rearwardly. The second wheel 16 is maintained between the two arms, rotating about a second axle 20.

Although the frame 12 of the present invention consists of a pair of mated half-shells, it is within the spirit and scope of the present invention that the frame 12 be some other monocoque construction or a separate frame/separate body construction. "Frame" is intended to cover both a monocoque construction in which the body also functions as a chassis bearing loads on the vehicle as well as a conventional chassis supporting a separate mounted body.

Figure 3:
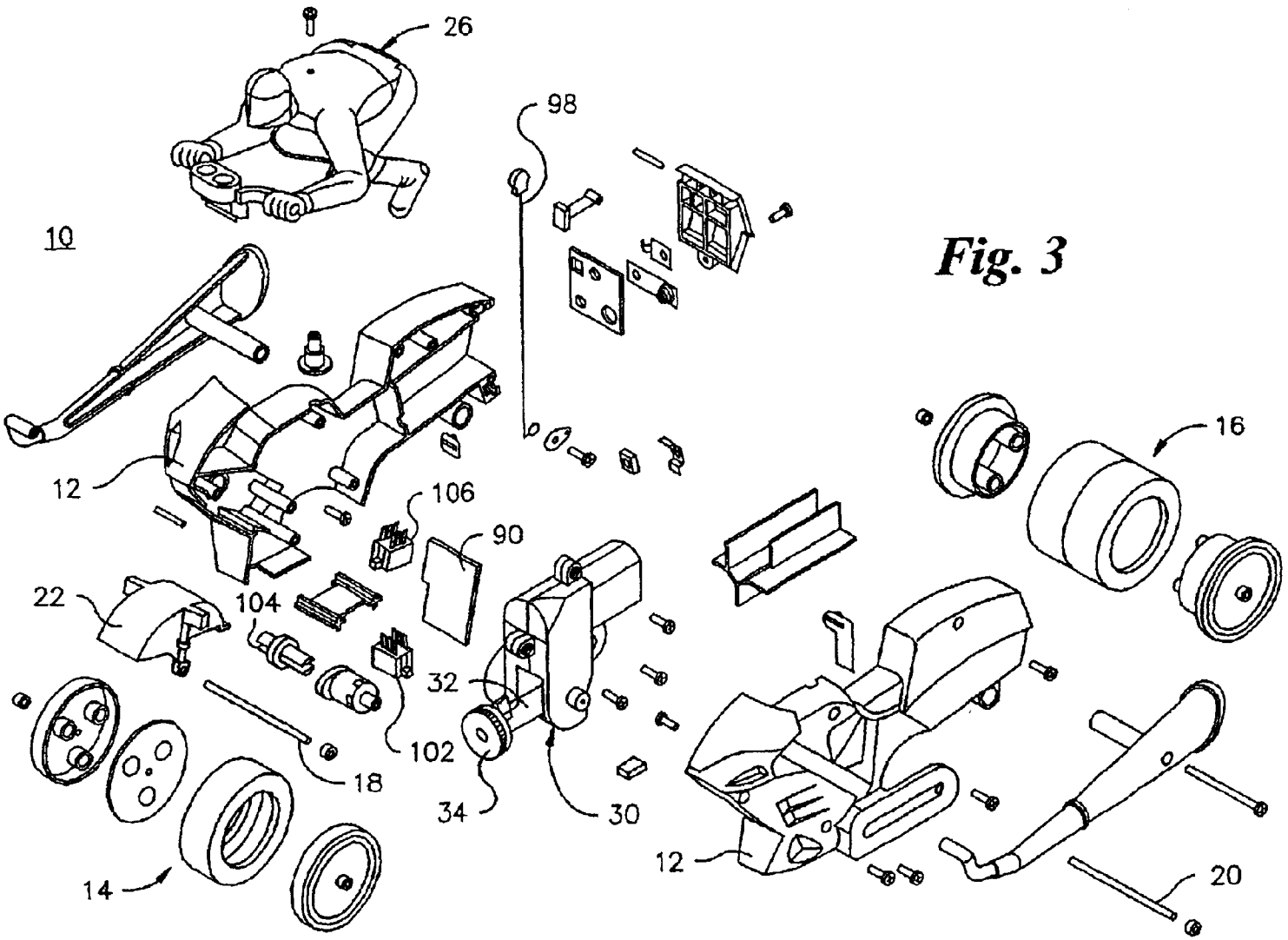
FIG. 3 is an exploded view of the toy vehicle of FIG. 1.
Figure 5:
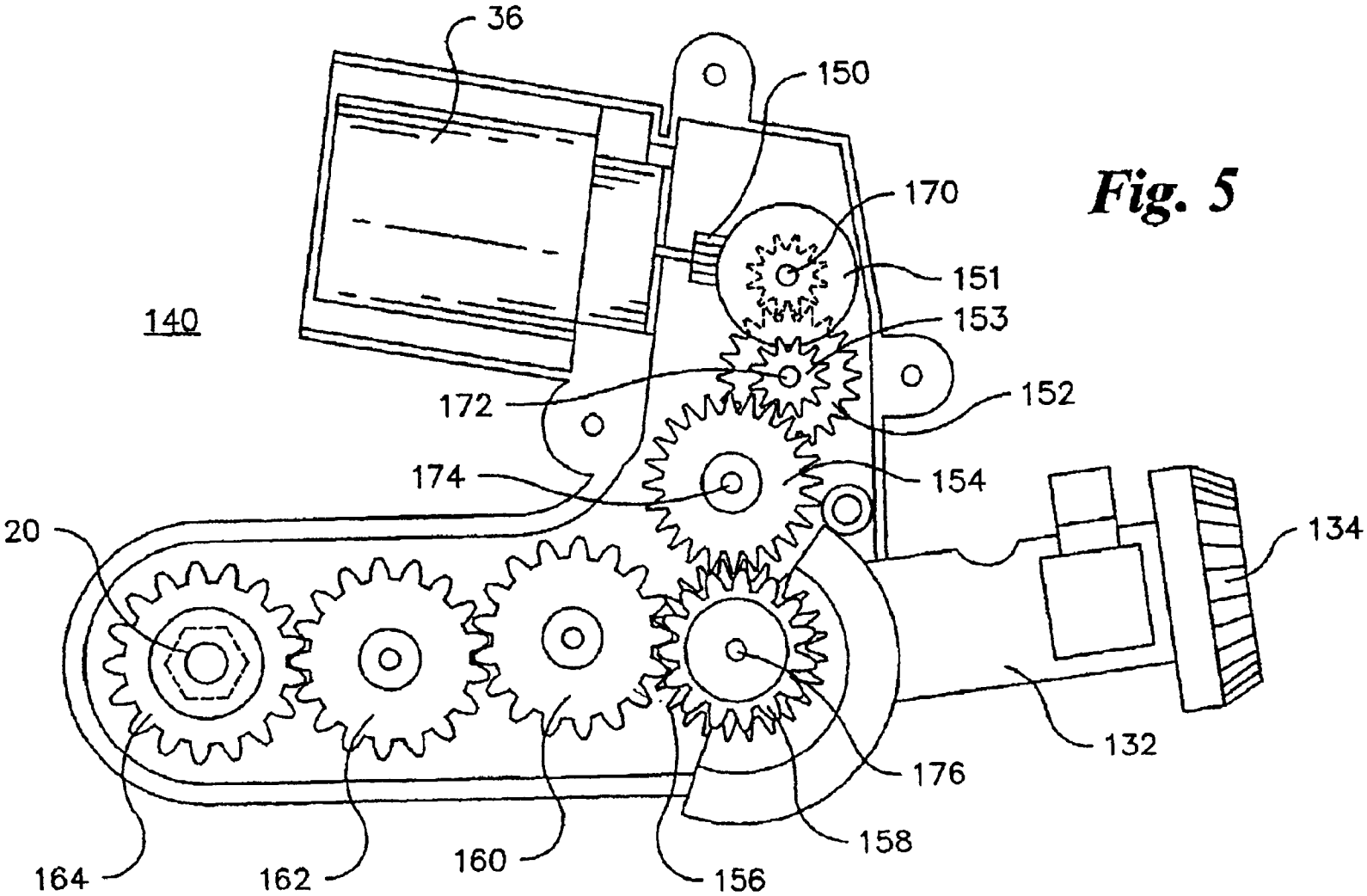
FIG. 5 is a side plan view of the second embodiment of the power take-off mechanism of the toy vehicle of FIG. 1.

Referring to FIGS. 1, 3, and 5, a turning mechanism 30 is mounted on the bottom of the frame 12 between the first and second wheels 14, 16 (see FIG. 1). Specifically, the turning mechanism 30 includes a housing 31 with a rotatable arm 32, a proximal end of which is mounted to the frame 12 through the housing 31, and a third, steering wheel 34 rotatably mounted to a distal end of the arm 32. The arm 32 is rotatable along the center vertical plane of the frame 12. The third wheel 34 is rotatable to move the motorcycle vehicle 10 in a direction transverse to the center vertical plane of the frame 12. The arm 32 is rotatable between a retracted position and an extended position. In the retracted position, the arm 32 and the third wheel 34 are both held within the frame 12 so that the third wheel 34 does not contact the surfaces supporting the vehicle 10. This allows the vehicle 10 to be propelled along a relatively straight line with only the first and second wheels 14, 16 contacting the surface. In the extended position, the arm 32 is rotated downwardly from within the frame 12 to abut a stop member 38 integral to the housing 31, exposing the third wheel 34 and raising and maintaining the vehicle 10 in a wheelie-like position. The third wheel 34 contacts the surface and lifts the first front wheel 14 off of the surface. When in a fully extended position, the third wheel 34 rotates, causing the vehicle 10 to rotate about the second wheel 16, which is still in contact with the surface in a direction perpendicular to the central longitudinal plane. Although it is preferred that the turning mechanism 30 allows rotation of the vehicle 10 about the second, rear wheel 16, it is within the spirit and scope of the invention for the turning mechanism 30 to be mounted and oriented such that the second wheel 20 is lifted off of the surface and the vehicle 10 is rotated about the first wheel 14.

Figure 4:
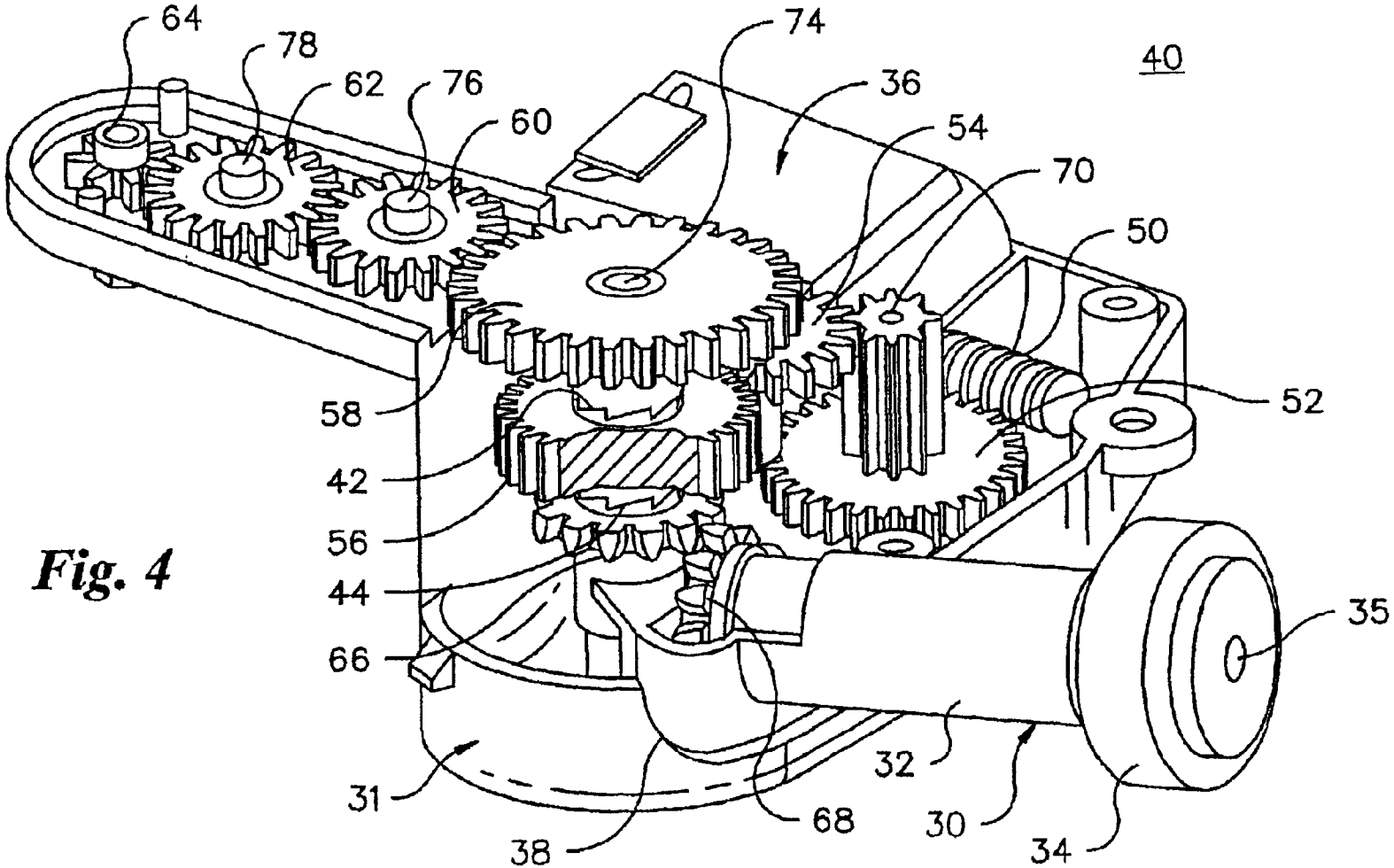
FIG. 4 is a perspective view of the first embodiment of the power take-off mechanism of the toy vehicle of FIG. 1.

Referring now to FIG. 4, a motor 36 is mounted to and maintained within the frame 12 in housing 31. Preferably, the motor 36 is bi-directional and electrical. The motor 36, when operating in a first direction, is operatively associated with the second wheel 16 in order to propel the vehicle 10. When operating in a second direction, opposite the first direction, the motor 36 is operatively associated with the turning mechanism 30 in order to lift and turn the vehicle 10. It is within the spirit and scope of the invention that the first wheel 14 be operatively associated with the motor 36 either instead of or in addition to the second wheel 16 in order to propel the vehicle 10.

Referring to FIG. 4, a power take-off mechanism 40 allows the motor 36 to either power the second wheel 16 to propel the vehicle 10 or power the turning mechanism 30 to turn the vehicle 10. The power take-off mechanism 40 includes the motor 36 and a transmitting gear train 47 which either operably engages with a propulsion gear train 57 or a turning gear train 65. The motor 36 directly engages the transmitting gear train 47. The motor 36 is oriented such that it produces rotation in a direction transverse to the center vertical plane of the frame 12. The transmitting gear train 47 consists of a worm 50, a step-down compound gear member 52, a first spur gear member 54, and a clutch gear member 56. The worm 50 is directly engaged with the rotating member of the motor 36. The larger gear of the compound gear member 52 engages the worm 50 such that the compound gear member 52 is rotated about a first spindle 70. The smaller gear of the compound gear member 52 is engaged with and rotates the first spur gear member 54 about a second spindle 72, which is parallel to the first spindle 70. The first spur gear member 54 in turn causes the clutch gear member 56 to rotate about the third spindle 74.

The clutch gear member 56 selectively engages either the propulsion gear train 57 or the turning gear train 65, depending on the direction of rotation imparted on it by the motor 36. This selective engagement is achieved through the use of a first and a second clutch 42, 44. The first clutch 42 is a slip clutch with a sawtooth interface between the clutch gear member 56 and a second spur gear member 58, also rotating about the third spindle 74. The sawtooth interface of the first clutch 42 allows relative motion between the clutch gear member 56 and the second spur gear member 58 when the motor 36 operates in the second direction, pushing the second spur gear member 58 away from the clutch gear member 56 along the third spindle 74 and imparting no rotation to the second spur gear member 58. When the motor 36 operates in a first direction, the sawtooth interface of the first clutch 42 permits no relative motion between the clutch gear member 56 and the second spur gear member 58 causing the second spur gear member 58 to rotate with the clutch gear member 56.

The propulsion gear train 57 is made up of the second spur gear member, a third spur gear member 60, a fourth spur gear member 62 and a fifth spur gear member 64. Rotation of the second spur gear member 58 about the third spindle 74 causes rotation of the third spur gear member 60 about a fourth spindle 76. Rotation of the third spur gear member 60 then causes rotation of the fourth spur gear member 62 about a fifth spindle 78. The fourth spur gear member 62 engages the fifth spur gear member 64 which rotates about the second axle 20. The fifth spur gear member 64 is engaged with the second wheel 16 so as to produce rotation of the second wheel 16 about the second axle 20. Preferably, the propulsion gear train 57 is held within one of the arms of the rear wheel mount 24.

The second clutch 44 is another slip clutch with a sawtooth interface between the clutch gear member 56 and a first bevel gear member 66, also rotating about the third spindle 74. The second clutch 44 operates in generally the same manner as the first clutch 42, except that its sawteeth are reversed from those of the first clutch 42 such that it slips and causes relative motion between the clutch gear member 56 and the first bevel gear member 66 when the motor 36 operates in the first direction and allows engagement between the clutch gear member 56 and the first bevel gear member 66 in the second direction. This configuration allows the motor 36 to alternatively power either the second wheel 16 or the turning mechanism 30.

When the motor 36 is driven in the second direction, the clutch gear member 56 engages the first bevel gear member 66 via the second clutch 44, such that the first bevel gear gear member 66 rotates in the same direction as the clutch gear member 56 about the third spindle 74. The first bevel gear member 66 engages the other gear of the turning gear train 65, a second bevel gear member 68, mounted perpendicular to the first bevel gear member 66 on a proximal end of a third axle 35 which is maintained within and runs the length of the rotatable arm 32. The third wheel 34 is fixedly mounted to a distal end of the third axle 35. When the rotatable arm 32 is in the retracted position, because of friction along the turning gear train 65, rotation of the first bevel gear member 66 causes the second bevel gear member 68 to "walk" around the first bevel gear member 66, thereby rotating the rotatable arm 32. Rotation of the rotatable arm 32 will cease when the rotatable arm 32 contacts the stop member 38 and achieves its extended position, at which point the friction within the rotatable arm 32 will be overcome allowing rotation of the second bevel gear member 68, the third axle 35, and the third wheel 34, causing the vehicle 10 to turn.

Figure 6:
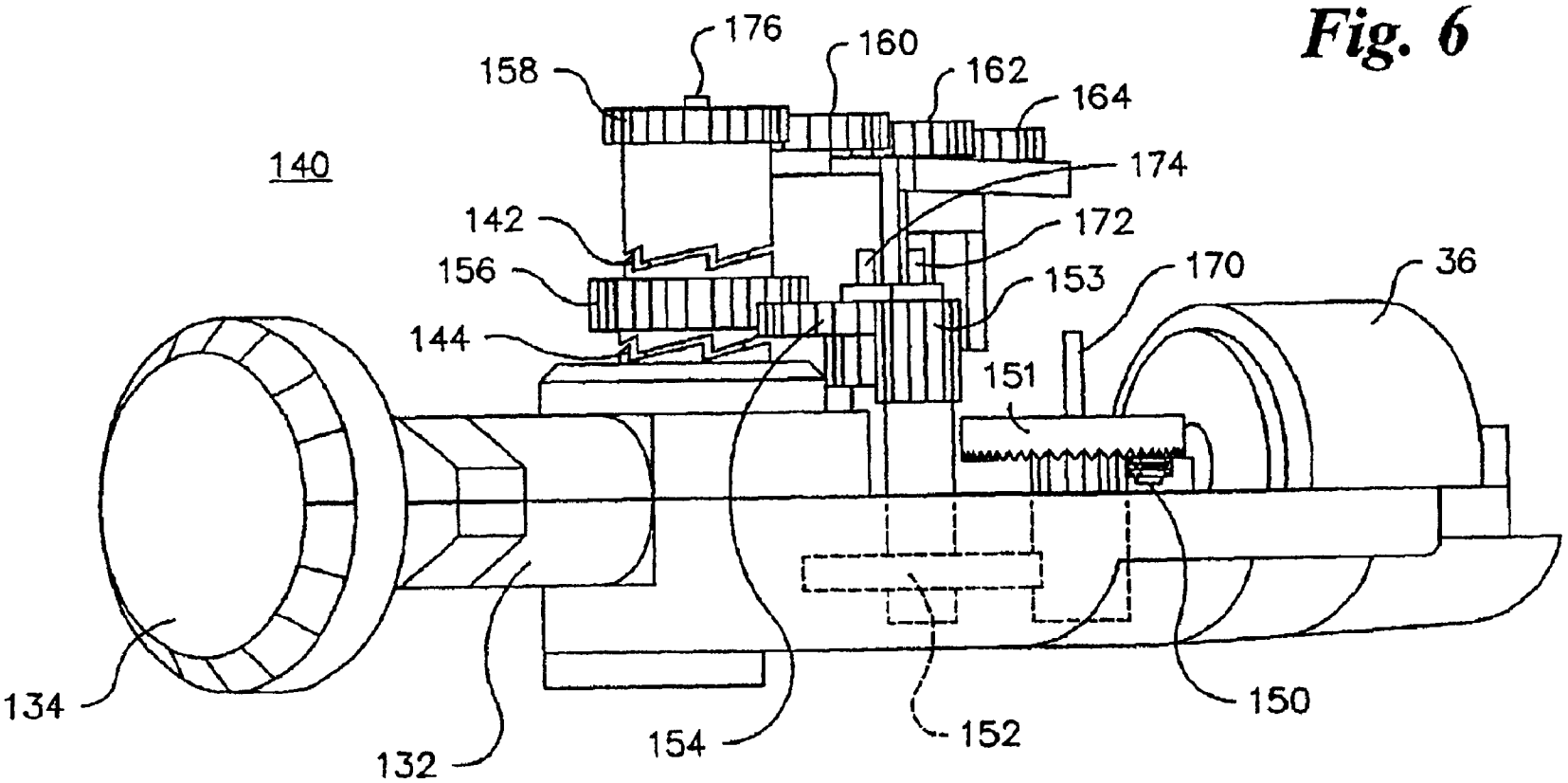
FIG. 6 is a side elevation view of the second embodiment of the power take-off mechanism of the toy vehicle of FIG. 1.
Figure 7:
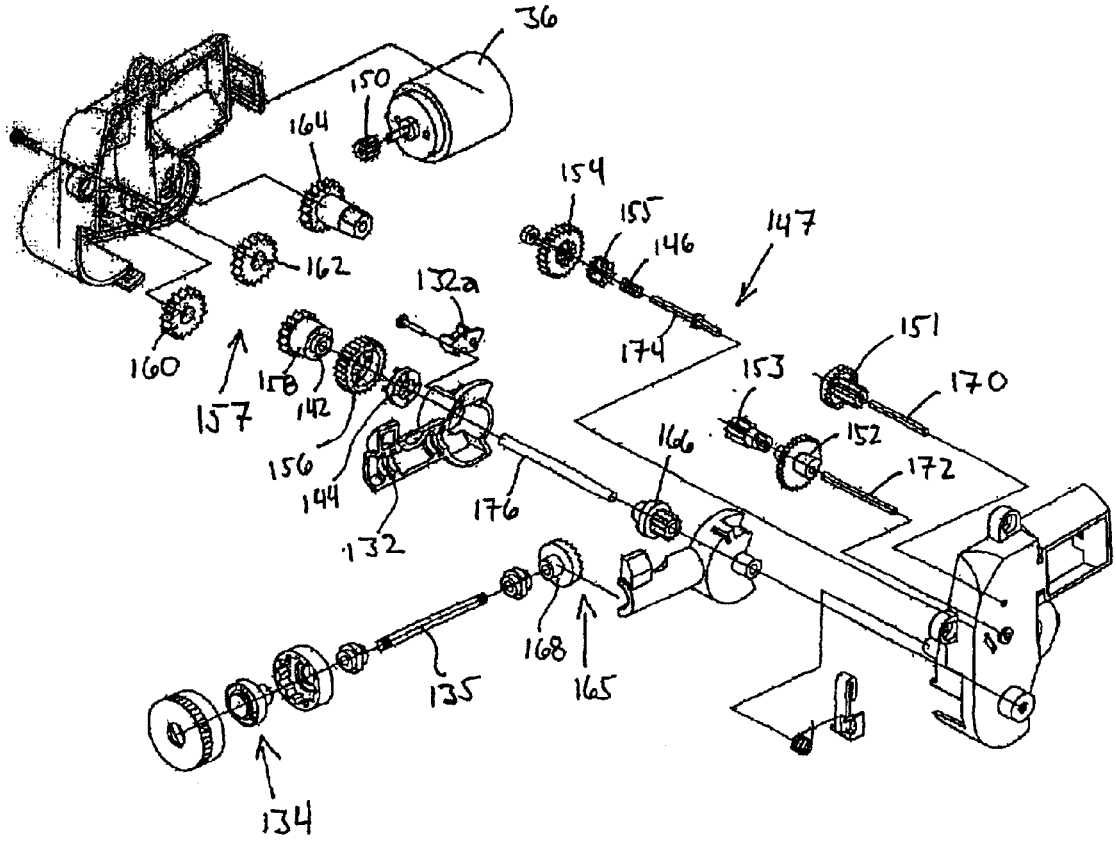
FIG. 7 is an exploded view of the second embodiment of the power take-off mechanism of the toy vehicle of FIG. 1.

Referring to FIGS. 5, 6, and 7, a second embodiment of the present invention can be seen. A power take-off mechanism 140 is powered by the bi-directional motor 36. The power take-off mechanism 140 has three different gear trains: a transmitting gear train 147, a propulsion gear train 157, and a turning gear train 165.

The transmitting gear train 147 has a first pinion gear 150, a first compound gear 151, a first spur gear 152, a second spur gear 153, a second compound gear 154, a third compound gear 155, and a clutch gear 156. The pinion gear 150 is rigidly engaged with the spindle of the motor 36 so that the pinion gear 150 rotates with the motor spindle. The pinion gear 150 engages and rotates the crown gear part of the first compound gear 151, thereby rotating the first compound gear 151 about a first spindle 170. The spur gear part of the first compound gear 151 engages with and rotates the first spur gear 152 about a second spindle 172. The first spur gear 152 engages with the second spur gear 153, which also rotates about the second spindle 172, such that they both rotate in the same direction, essentially creating a compound gear. The second spur gear 153 engages with and rotates the spur gear part of the second compound gear 154 about a third spindle 174. The side gear part of the second compound gear 154 engages with the side gear part of the third compound gear 155, which also rotates about the third spindle 174. The third compound gear 155 is biased toward the second compound gear 154 with a spring 146, enabling engagement of and no relative rotation between the second and third compound gears 154, 155 under normal conditions, but also enabling the third compound gear 155 to slip away from the rotation of the second compound gear 154 if the third compound gear 155 should bind. The third compound gear 155 selectively engages with teeth 132*a* on a rotatable arm housing 132, and, when rotating in the proper direction, causes the rotatable arm 32 to lower. The spur gear part of the second compound gear 154 also engages the clutch gear 156 and rotates it about a fourth spindle 176.

The clutch gear 156 is the point at which power is either directed to propel the vehicle 10 or to turn the vehicle 10. A first and a second clutches 142, 144 on either side of the clutch gear 156 allow for interaction between either a propulsion gear train 157 or a turning gear train 165, depending on the direction of rotation of the clutch gear 156. The method with which this is accomplished is described above.

The propulsion gear train has a third spur gear 158, a fourth spur gear 160, a fifth spur gear 162, and a sixth spur gear 164. The third spur gear 158, rotating about the fourth spindle 176, has a surface that meshes with the first clutch 142 of the clutch gear 156, allowing the third spur gear 158 to be rotated with the clutch gear 156 when the motor 50 operates in a first direction. The third spur gear 158 then engages with the fourth spur gear 160, which engages with the fifth spur gear 162, which then engages with the sixth spur gear 164. The sixth spur gear 164 then directly engages with the second wheel 16 in order to rotate it. In this way, propulsion of the vehicle 10 is accomplished.

The turning gear train 165 has a second pinion 166 and an umbrella gear 168. If the motor is operated in a second direction, the second clutch 144 engages a meshing surface of the second pinion 166, causing the second pinion 166 to rotate about the fourth spindle 176. The second pinion 166 engages the umbrella gear 168, which is oriented at a right angle to the second pinion 166. The umbrella gear 168 is directly engaged with a third axle 135, such that rotation of the umbrella gear 168 causes rotation of the third axle 168. A third wheel, indicated generally as 134, is engaged with the third axle 135, such that rotation of the third axle 135 causes rotation of the third wheel 134.

When the motor 36 is operated in the second direction, the third compound gear 155 engages with the teeth 132*a* of the rotatable arm housing 132, causing the rotatable arm housing 132 to pivot into a lowered position. Also, rotation of the motor 36 in the second direction causes meshing of the second clutch 144 with the second pinion gear 166, transmitting power through the turning gear train 165 and causing the third wheel 134 to rotate. In this way, turning of the vehicle 10 is achieved.

Referring now to FIG. 3, a wheelie switch 106 is located within the frame 12 such that the rotatable arm 32 contacts and closes the wheelie switch 106 when the turning mechanism 30 is in the retracted position. If the power switch 102 is rotated to the off position with the turning mechanism 30 in the extended position (and not in contact with the wheelie switch 106), the consequently open wheelie switch 106 causes the motor 36 to rotate in the first direction, propelling the vehicle 10 forward and moving the turning mechanism 30 to the retracted position. Once in the retracted position, the rotatable arm 32 of the turning mechanism 30 contacts the wheelie switch 106 and cuts power to the motor 36. When the power switch 102 is in the on position, the wheelie switch 106 does not affect the direction of rotation of the motor 36 or the control of the vehicle 10 in any way.

Referring to FIG. 3, an on-board control unit 90 is mounted to and maintained within the frame 12 of the vehicle 10. The on-board control unit 90 is electrically coupled to the motor 36 and configured to receive and process control signals transmitted from a remote source spaced from the vehicle 10 to remotely control movement of the vehicle 10 by a user. The user, if within a predetermined distance from the vehicle 10, will be able to remotely control the motor 36 to either rotate in the first direction, thereby propelling the vehicle 10 in a generally straight line, or in the second direction, thereby causing the vehicle 10 to turn.

Figure 2:
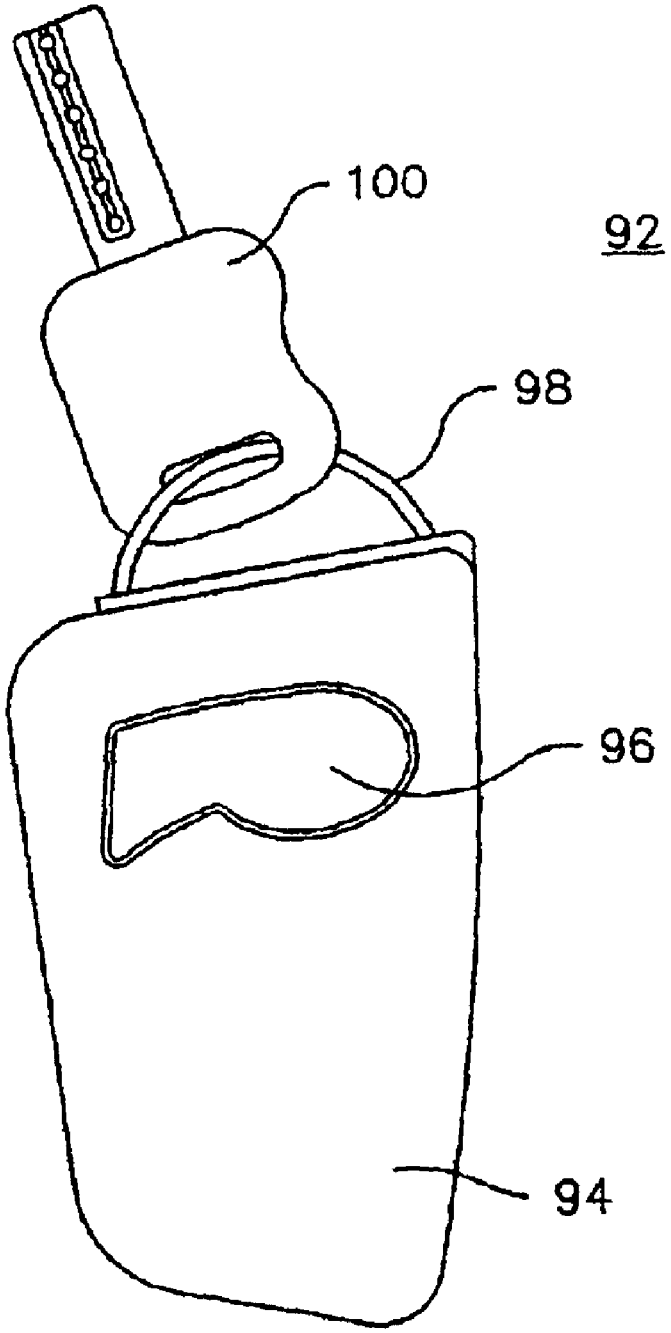
FIG. 2 is a side elevation view of the remote control unit used in combination with the toy vehicle of FIG. 1.

Referring now to FIG. 2, it is preferred that the user control the movement of the vehicle 10 using a remote control unit 92. Preferably, the remote control unit 92 is shaped to resemble a remote-vehicle-entry keychain. The remote control unit 92 has a housing 94, generally rectangular in shape and of a size that is capable of being held within and controlled by a single hand of the user. Generally centrally located on the housing 94 is a switch 96. The switch 96 is movable between a first position and a second position. When the switch 96 is in the default first position, a signal is sent to the on-board control unit 90 causing the motor 36 to be rotated in the second direction, causing the rotatable arm 32 to rotate into its extended position and rotating the third wheel in order to turn the vehicle 10. The switch 96 is in the second position, a signal is sent to the on-board control unit 90 to cause rotation of the motor 36 in the first direction, which causes the second wheel 16 to be rotated, thereby propelling the vehicle 10 along the surface. Although it is preferred that the switch 96 is a button, it is understood by those skilled in the art, that the switch 96 can be of another form, such as a slider switch or a motion sensitive switch.

To further resemble a remote-vehicle-entry keychain, an antenna 98 is engaged with the top of the housing 94 at both a first and a second end, such that the antenna 98 forms a semicircular loop. The antenna 98 rigidly maintains the semicircular shape and has a plastic key member 100 attached thereto. The key member 100 is generally shaped like a key for starting a motorcycle or other motor vehicle.

The vehicle 10 has a power switch 102 (FIG. 1) mounted to the frame 12. The power switch 102 is rotatable from an off position to an on position. The power switch 102 also has a channel 104 within it. The power switch is meant to be toggled between the off position and the on position using the key member 100, which is inserted into the channel 104 within the power switch 102. The key element 100 can be turned either clockwise or counter clockwise to turn the vehicle on or off, thereby simulating a key ignition system.

Referring to FIG. 1, the vehicle 10 contains a battery compartment 28 within the frame 12. Preferably, the battery compartment 28 is located toward the rear of the vehicle 10 above and rearward of the second wheel 16. This orientation allows the center of gravity of the vehicle 10 to be located toward the rear of the vehicle 10 so that less force is needed to lift up the front of the vehicle 10 when the turning mechanism 30 is activated to turn the vehicle 10.

Additionally, a toy FIG. 26 is connected to the frame 12 to simulate a rider on a motorcycle. Preferably, the FIG. 26 is rigidly attached to the frame 12 and incapable of movement, but it is within the spirit and scope of the invention that the FIG. 26 be removably engaged with the frame 12 and/or adjustable into different configurations.

Figure 8:
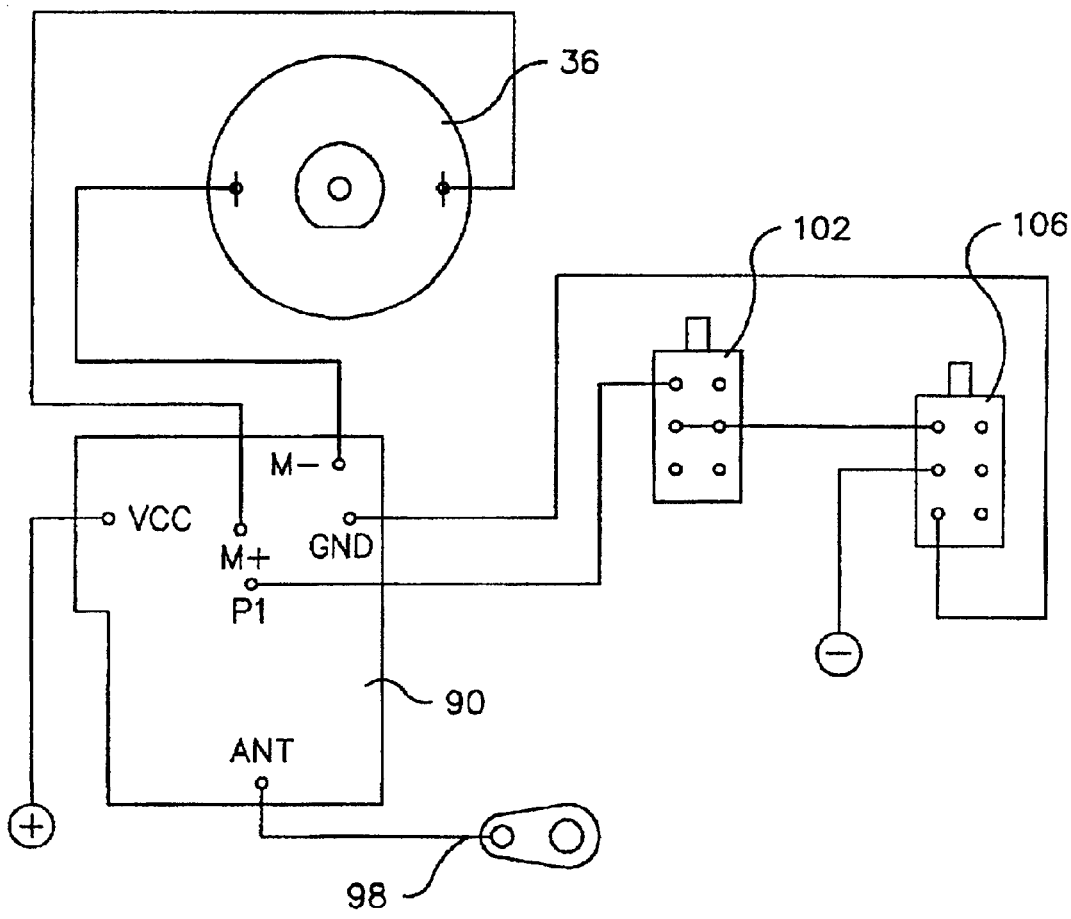
FIG. 8 is a schematic of the control circuit for the toy vehicle of FIG. 1.

Referring to FIG. 8, there is shown a sample control circuit for use within the vehicle 10. The on-board control unit 90 receives signals from the remote control unit 92 (FIG. 2) to determine the direction of rotation for the motor 36, provided the power switch 102 is turned to an on position. The wheelie switch 106, when closed, causes the motor 36 to operate to retract the turning mechanism 30 when it is in a lowered position when the power switch 102 is in an off position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy vehicle configured to be maneuvered on a surface, the vehicle comprising:

a frame;

a first wheel and a second wheel each rotatably mounted to the frame, the first wheel and the second wheel being generally in line along a center vertical plane of the frame and parallel to each other and to the center vertical plane; and a turning mechanism including a rotatable arm mounted to the frame and a third wheel mounted to the arm, the third wheel being rotatable about an axis parallel to the center vertical plane, the arm being rotatable between a retracted position and an extended position, wherein, in the extended position, the third wheel contacts the surface and lifts one of the first and second wheels off of the surface and the third wheel rotates to rotate the vehicle about a remaining one of the first and second wheels in contact with the surface.

2. The toy vehicle according to claim 1 further comprising a motor mounted on the frame, the motor being operatively associated with at least one of the first and second wheels to propel the vehicle, and further being operatively associated with the turning mechanism to lift and turn the vehicle.

3. The toy vehicle according to claim 1 wherein the turning mechanism is mounted on the frame between the first and second wheels, and wherein at least an end of the arm supporting the third wheel is extendable from the bottom of the frame.

4. The toy vehicle according to claim 1 wherein the first and second wheels are sufficiently wide and flat, such that the vehicle is capable of standing upright on the first and second wheels while the vehicle is stationary.

5. The toy vehicle according to claim 1 in combination with a remote control unit, wherein the remote control unit is configured to direct movement of the toy vehicle, the remote control unit having a switch, the switch being movable between a first position and a second position, whereby, when the switch is in the first position, the arm rotates into the extended position causing the toy vehicle to turn, and, when the switch is in the second position, the toy vehicle is propelled along the surface.

6. The toy vehicle according to claim 1 further comprising:

a toy figure connected to the frame; and a battery compartment within the frame, the compartment being located proximate the rear of the vehicle, such that when batteries are installed, the center of gravity of the vehicle is proximate the rearmost of the first and second wheels.

7. The toy vehicle according to claim 2 further comprising an on-board control unit operably coupled with the motor and configured to receive and process control signals transmitted from a remote source spaced from the vehicle to remotely control movement of the vehicle.

8. The toy vehicle according to claim 4 wherein the second wheel is wider than the first wheel.

9. The combination of claim 5 wherein the remote control unit comprises:

a housing sized to be hand-held by a child;

an antenna formed in a loop with a first end and a second end, both engaged with the housing; and a key member slidably attached to the antenna.

10. The combination of claim 9 wherein a power switch is mounted to the vehicle, the power switch being rotatable between an on position and an off position, the power switch having a channel therein configured to receive an end of the key to facilitate rotation of the power switch to one of the on and off positions.

11. A toy vehicle for use on a surface, the vehicle comprising:

a frame having a first and a second end;

a motor mounted to the frame;

at least a first propulsion wheel operatively coupled with the motor and rotatably mounted to the frame proximal one of the first and second ends; and a turning mechanism operatively coupled with the motor and including a rotatable arm mounted to the frame and a rotatable steering wheel mounted to the arm, the arm being rotatable between a retracted position and an extended position, wherein, in the extended position, the steering wheel contacts the surface and lifts one of the first and second ends off of the surface and the steering wheel rotates to turn the vehicle about a remaining one of the first and second ends in contact with the surface.

12. A toy vehicle for use on a surface, the vehicle comprising:

a frame having a first end, a second end, and a center vertical plane extending along a centerline of the frame from the first end to the second end;

at least a first wheel and a second wheel each rotatably mounted to the frame;

a turning mechanism including a rotatable arm mounted to the frame and a third wheel mounted to the arm, the third wheel being rotatable in a direction transverse to the center vertical plane, the arm being rotatable between a retracted position and an extended position, wherein, in the extended position, the third wheel contacts the surface and lifts at least one of the first and second wheels off of the surface and the third wheel rotates to rotate the vehicle about a remaining at least one of the first and second wheels in contact with the surface.

13. The toy vehicle according to claim 12 further comprising:

a motor mounted on the frame; and a power take-off mechanism operably coupling the motor with at least one of the first and second wheels and with the turning mechanism.

14. The toy vehicle according to claim 13 wherein the power take-off mechanism comprises:

a first clutch operably coupled with the motor;

a second clutch operably coupled with the motor;

a first gear train being operably coupled to at least one of the first and second wheels; and a second gear train being operably coupled to the turning mechanism;

wherein, upon the motor operating in a first direction, the first clutch causes engagement of the motor with the first gear train and the second clutch causes disengagement of the motor with the second gear train, causing the rotation of the one of the first and second wheels, thereby propelling the vehicle;

wherein, upon the motor operating in a second direction, the second clutch causes engagement of the motor with the second gear train and the first clutch causes disengagement of the motor with the first gear train, causing rotation of the arm into the extended position and rotation of the third wheel, thereby turning the vehicle.

15. A power take-off mechanism for use in propelling and turning a toy vehicle having at least a first propulsion wheel, the power take-off mechanism comprising:

a motor;

a first clutch operably coupled with the motor so as to transfer rotation of the motor in only a first direction;

a second clutch operably coupled with the motor so as to transfer rotation of the motor in only a second direction opposite the first direction;

a first gear train being operatively coupled to at least the first propulsion wheel and the first clutch; and a second gear train being operatively coupled to a turning mechanism and the second clutch;

wherein, upon the motor operating in a first direction, the first clutch causes engagement of the motor with the first gear train and the second clutch causes disengagement of the motor with the second gear train, causing the rotation of at least the first propulsion wheel, thereby propelling the vehicle; and wherein, upon the motor operating in a second direction, the second clutch causes engagement of the motor with the second gear train and the first clutch causes disengagement of the motor with the first gear train, causing rotation of the turning mechanism, thereby turning the vehicle.

* * * * *